US005657981A

United States Patent [19]

Kelly et al.

[11] Patent Number: 5,657,981

[45] Date of Patent: Aug. 19, 1997

[54] SHEET SEPARATING APPARATUS FOR REMOVING SHEETS ONE-BY-ONE FROM AT LEAST ONE STACK OF SHEETS

[75] Inventors: Kenneth Kelly; Adam J. Crighton; George Petrie, all of Dundee; Robert J. Suttie, Alyth; Robert Petrie, Dundee; Alistair Ballantyne, Dundee; Thomas Gow, Dundee, all of Scotland

[73] Assignee: NCR Corporation, Dayton, Ohio

[21] Appl. No.: 596,847

[22] Filed: Feb. 5, 1996

[30] Foreign Application Priority Data

Sep. 8, 1995 [GB] United Kingdom ..... 9518346

[51] Int. Cl.[6] ..... B65H 3/44; B65H 3/08

[52] U.S. Cl. ..... 271/9.01; 271/11; 271/108

[58] Field of Search ..... 271/97, 98, 108, 271/9.01, 11, 107

[56] References Cited

U.S. PATENT DOCUMENTS

| | | | |
|---|---|---|---|
| 1,418,145 | 5/1922 | Fischer | 271/98 |
| 2,158,335 | 5/1939 | Milmoe | 271/108 |
| 2,764,407 | 9/1956 | Alix | 271/108 |
| 3,294,396 | 12/1966 | Staines | 271/108 X |
| 3,419,263 | 12/1968 | Weidman | 271/108 |
| 4,436,300 | 3/1984 | Goi | 271/108 X |
| 4,494,743 | 1/1985 | Kushmaul et al. | 271/108 X |
| 4,579,330 | 4/1986 | Lehmann | 271/108 X |
| 5,062,603 | 11/1991 | Smith et al. | 271/108 X |
| 5,112,040 | 5/1992 | Johnston et al. | 271/11 |
| 5,451,086 | 9/1995 | Pazzaglia | 271/108 X |

FOREIGN PATENT DOCUMENTS

| | | | |
|---|---|---|---|
| 0448385 | 9/1991 | European Pat. Off. . | |
| 394549 | 6/1933 | United Kingdom | 271/98 |

*Primary Examiner*—Boris Milef

*Attorney, Agent, or Firm*—Michael Chan

[57] ABSTRACT

In a sheet separating apparatus, for example an automated teller machine (ATM) in which banknotes are removed one by one from a stack (12) of banknotes, includes a vacuum pump (32), and suction unit (10A,B,C,D) connectable alternately between a vacuum enable port (30) of the vacuum pump (32) when a note is picked from the stack (12), and a vacuum release port (42) of the pump (32), when the note is released from the suction unit. Pre-filtered air from the vacuum pump (32) is therefore partially recycled, and dust is substantially excluded from the system.

4 Claims, 1 Drawing Sheet

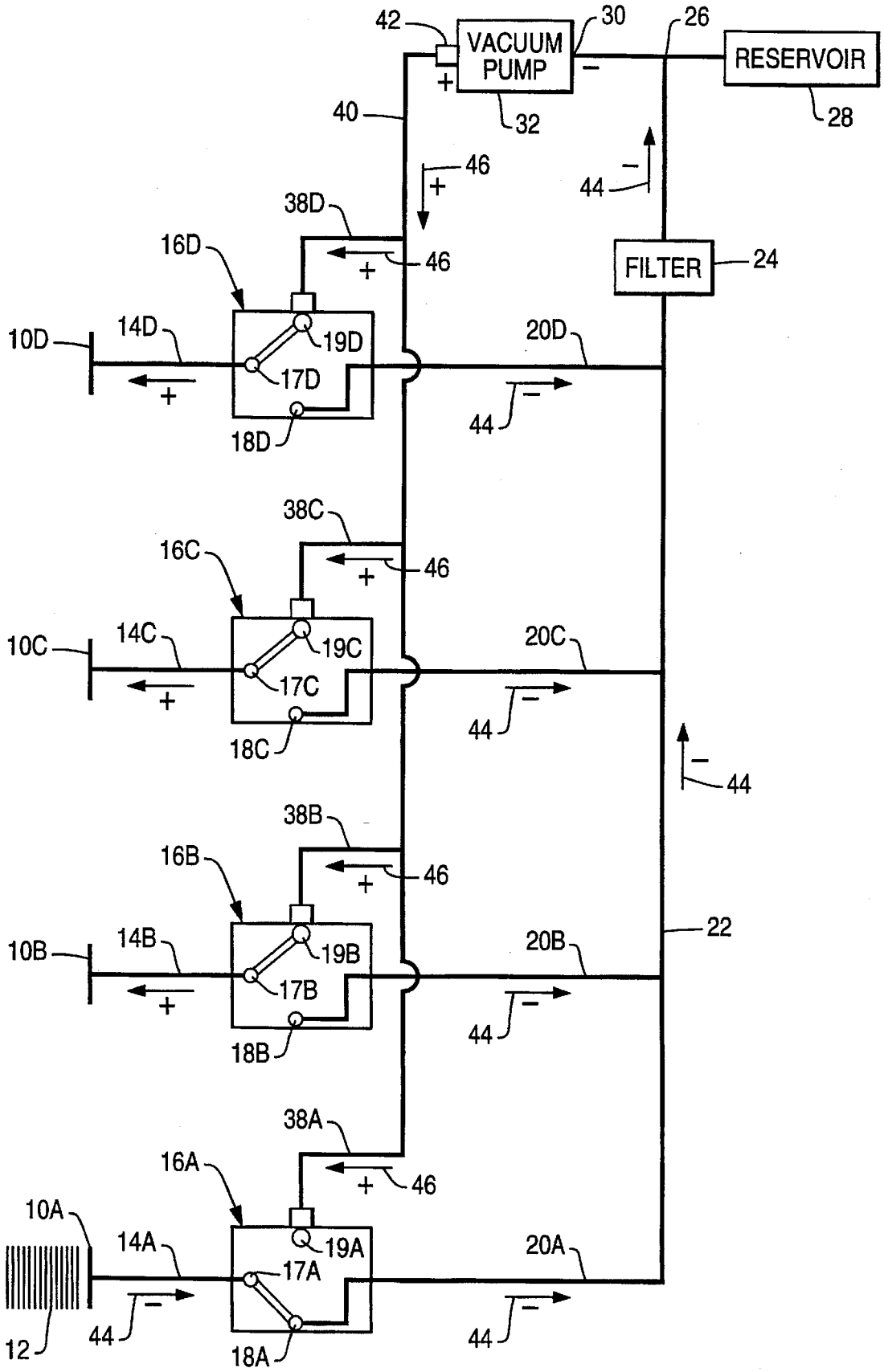
VACUUM PUMP
RESERVOIR
FILTER
42
30
26
32
28
40
46
44
38D
16D
24
10D
14D
19D
17D
18D
20D
38C
16C
10C
14C
19C
17C
18C
20C
38B
16B
10B
14B
19B
17B
18B
20B
22
38A
16A
10A
14A
19A
17A
18A
20A
12

SHEET SEPARATING APPARATUS FOR REMOVING SHEETS ONE-BY-ONE FROM AT LEAST ONE STACK OF SHEETS

BACKGROUND OF THE INVENTION

This invention relates to a sheet separating apparatus for removing sheets one by one from a stack of sheets.

The invention has application, for example, to a currency note picking apparatus for extracting notes from a currency cassette used in an automated teller machine (ATM). As is well known, in operation of an ATM a user inserts a customer identifying card into the machine and then enters certain data (such as codes, quantity of currency required or to be paid in, type of transaction, etc.) upon one or more keyboards associated with the machine. The machine will then process the transaction, update the users account to reflect the current transaction, dispense cash, when requested, extracted from one or more currency cassettes mounted in the machine, and return the card to the user as part of a routine operation.

One known type of sheet separating apparatus is described in European Patent Application No. 0 448 385. Vacuum operated picking devices apply suction force to the end note in a stack of notes in a cassette, and move the notes towards rollers which hold the notes while the suction force is removed. The rollers then move the notes to the cash dispensing part of the apparatus.

In this example, the suction force is removed by venting the suction device to the atmosphere. Inevitably, dust and grit are drawn into the system from the atmosphere, and the associated vacuum pump initially becomes inefficient, and eventually fails. Depending on the environment, the period between failures varies from about a year in relatively clean atmospheres to as little as a week in atmospheres with a high percentage of dust or even sand. Repairing the apparatus on a frequent basis is, of course, expensive. Even if a filter is provided between the pump and the atmosphere, then, in dusty environments, a minimum of three failures each year can still be expected, which is unacceptably frequent.

SUMMARY OF THE INVENTION

An object of the invention is to provide a sheet separating apparatus which is less sensitive to dust and grit in its operating environment and which therefore has a substantially increased time between failures.

According to the invention a sheet separating apparatus for removing sheets one by one from a stack of sheets comprises vacuum pump means for generating a reduced pressure; and suction means connectable to said pump means and serving to apply a suction force to one sheet so as to remove it from the stack, and subsequently to release the suction force, characterized in that the suction means is connectable alternately between a vacuum enable port and a vacuum release port of the pump means.

It is an advantage of apparatus according to the invention that air associated with the vacuum pump is partially recycled. Optionally the suction means is a pick cup, and preferably there is provided an associated valve which is connectable either to a vacuum line connected to the vacuum enable port of the pump or to a release line connected to the vacuum release port of the pump.

Preferably there are a plurality of pick cups.

Preferably the apparatus further comprises filter means associated with the vacuum enable port of the vacuum pump. The filter means may be a separate filter in a vacuum supply line, or may be integral with the vacuum pump.

Preferably the apparatus comprises an automated teller machine and the sheets comprise banknotes.

BRIEF DESCRIPTION OF THE DRAWINGS

The invention will now be described by way of example only with reference to the accompanying drawing which is a schematic diagram of sheet separating apparatus according to the invention, suitable for use in an automated teller machine.

DETAILED DESCRIPTION

Since the invention relates largely to the provision and release of the suction force, pick cups, shown individually as pick cups 10A,10B,10C,10D, which can pick individual banknotes, for example from respective stacks of banknotes, such as the stack 12, are shown in highly schematic form, and other conventional parts of the note dispensing apparatus are omitted.

The pick cups 10A–10D are connected by tubes 14A–14D to valves show individually as valves 16A,16B,16C,16D. The valves 16A–16D have operating ports shown individually as operating ports 17A,17B,17C,17D and two inlet ports shown individually as inlet ports 18A–18D and 19A–19D. The first inlet ports 18A–18D are connected through individual vacuum lines, shown individually as vacuum lines 20A,20B,20C,20D, to a main vacuum line 22 which is connected through a filter 24 to a T-junction 26; one arm of the T is connected to a reservoir 28 and the other to the vacuum enable port 30 of a vacuum pump 32.

Each valve has its second outlet port connected through release lines, shown individually as 38A,38B,38C,38D to a main release line 40 which is connected to the vacuum release port 42 of the vacuum pump 32. The individual vacuum lines 20A–20D and the main vacuum line 22, the individual release lines 38A–38D and the main release line 40 may all be tubing of appropriate material and diameter.

In the FIGURE, the pick cup 10A, is in "pick" mode, whereas the other three pick cups 10B,10C,10D, are in release mode.

The valve 16A associated with the pick cup 10A is arranged, by conventional electronic means (not shown) so that its operating port 17A is connected internally to its first input port 18A; the vacuum generated by the vacuum pump 32 is therefore applied to the pick cup 10A, which can pick individual notes from the stack 12 by applying suction to them. Each note is removed from the stack by the pick cup 10A and moved by conventional mechanical means (not shown) to a position remote from the stack 12.

When the pick cup with the note held by suction reaches the remote position, the electronic means operates so that suction is released, and the note can be removed by e.g. rollers (not shown); the connections for suction release are shown in the other three pick cups. For example, in valve 16B associated with the pick cup 10B, the operating port 17B is connected to the second outlet port 19B; with this internal connection in place, the operating port 17B is connected through the vacuum release line 40 to the vacuum release port 42 of the pump 32. Any previous suction applied to the pick cup 10B is therefore released.

The application of vacuum through the lines 20A–20D, 22A–22D is indicated by the arrow 44, marked negative to indicate negative pressure; the application of vacuum release through the lines 38A–38D, 40 is indicated by the arrows 46, marked positive to indicate positive pressure.

By use of pre-filtered air from the pump 32, filtered air is partially recycled; dust and grit are not drawn into the system, and the pick cups 10A–10D and pump 32 remain operational for substantial periods of time, even in dusty atmospheres.

In addition to picking banknotes in an ATM, the invention has application in other sheet picking operations involving use of suction.

Although four pick cups are shown, a smaller number, e.g. two, may be required in an ATM dispensing notes of one or two denominations, or a greater number than four may be required in other sheet picking apparatus.

What is claimed is:

1. A sheet separating apparatus for removing sheets one by one from at least one stack of sheets, the sheet separating apparatus comprising:

a vacuum pump having a vacuum enable port and a vacuum release port; and a suction unit including a first suction cup and a first valve having (i) a first port connected in fluid communication with the vacuum release port of the vacuum pump, (ii) a second port connected in fluid communication with the vacuum enable port of the vacuum pump, and (iii) an operating port connected in fluid communication with the first suction cup;

the first valve having (i) a first position in which the operating port of the first valve communicates with the first port of the first valve to allow the vacuum pump to apply a positive pressure via the vacuum release port to the first suction cup to exhaust air through the first suction cup, and (ii) a second position in which the operating port of the first valve communicates with the second port of the first valve to allow the vacuum pump to apply a negative pressure via the vacuum enable port to the first suction cup to create a suction force for removing a sheet from a first stack of sheets while the vacuum pump is applying a positive pressure via the vacuum release port to a first location other than the first suction cup to exhaust air through the first location;

the suction unit including a second suction cup and a second valve having (i) a first port connected in fluid communication with the first port of the first valve and the vacuum release port of the vacuum pump, (ii) a second port connected in fluid communication with the second port of the first valve and the vacuum enable port of the vacuum pump, and (iii) an operating port connected in fluid communication with the second suction cup;

the second valve having (i) a first position in which the operating port of the second valve communicates with the first port of the second valve to allow the vacuum pump to apply a positive pressure via the vacuum release port to the second suction cup to exhaust air through the second suction cup, and (ii) a second position in which the operating port of the second valve communicates with the second port of the second valve to allow the vacuum pump to apply a negative pressure via the vacuum enable port to the second suction cup to create a suction force for removing a sheet from a second stack of sheets while the vacuum pump is applying a positive pressure via the vacuum release port to a second location other than the second suction cup to exhaust air through the second location;

the first location comprising the second suction cup, and the second location comprising the first suction cup.

2. A sheet separating apparatus according to claim 1, wherein (i) the second suction cup communicates with the first port of the second valve to exhaust air through the second suction cup when the first suction cup is communicating with the second port of the first valve, and (ii) the first suction cup communicates with the first port of the first valve to exhaust air through the first suction cup when the second suction cup communicates with the second port of the second valve.

3. A sheet separating apparatus according to claim 1, further comprising a filter which is connected in fluid communication between the vacuum enable port of the vacuum pump and the second ports of the first and second valves.

4. An automated teller machine (ATM) which stores at least one stack of banknotes, the ATM comprising:

a first container for storing a first stack of sheets;

a second container for storing a second stack of sheets; and a sheet separating mechanism for removing banknotes one by one from the first and second stacks of sheets;

the sheet separating mechanism including:

a vacuum pump having a vacuum enable port and a vacuum release port; and a suction unit including a first suction cup and a first valve having (i) a first port connected in fluid communication with the vacuum release port of the vacuum pump, (ii) a second port connected in fluid communication with the vacuum enable port of the vacuum pump, and (iii) an operating port connected in fluid communication with the first suction cup;

the first valve having (i) a first position in which the operating port of the first valve communicates with the first port of the first valve to allow the vacuum pump to apply a positive pressure via the vacuum release port to the first suction cup to exhaust air through the first suction cup, and (ii) a second position in which the operating port of the first valve communicates with the second port of the first valve to allow the vacuum pump to apply a negative pressure via the vacuum enable port to the first suction cup to create a suction force for removing a sheet from a first stack of sheets while the vacuum pump is applying a positive pressure via the vacuum release port to a first location other than the first suction cup to exhaust air through the first location;

the suction unit including a second suction cup and a second valve having (i) a first port connected in fluid communication with the first port of the first valve and the vacuum release port of the vacuum pump, (ii) a second port connected in fluid communication with the second port of the first valve and the vacuum enable port of the vacuum pump, and (iii) an operating port connected in fluid communication with the second suction cup;

the second valve having (i) a first position in which the operating port of the second valve communicates with the first port of the second valve to allow the vacuum pump to apply a positive pressure via the vacuum release port to the second suction cup to exhaust air through the second suction cup, and (ii) a second position in which the operating port of the second valve communicates with the second port of the second valve to allow the vacuum pump to apply a negative pressure via the vacuum enable port to the second suction cup to create a suction force for removing a sheet from a second stack of sheets while the vacuum pump is applying a positive pressure via the vacuum release port to a second location other than the second suction cup to exhaust air through the second location;

the first location comprising the second suction cup, and the second location comprising the first suction cup.

* * * * *